US005518484A

United States Patent [19]

Bruckenstein

[11] Patent Number: 5,518,484

[45] Date of Patent: May 21, 1996

[54] LEG STRETCHING DEVICE

[76] Inventor: Gordon C. Bruckenstein, 135 Murray Dr., Oceanside, N.Y. 11572

[21] Appl. No.: 318,182

[22] Filed: Oct. 5, 1994

[51] Int. Cl.[6] ..... A63B 23/04

[52] U.S. Cl. ..... 482/131; 482/907; 482/70

[58] Field of Search ..... 482/907, 139, 482/131, 132, 79, 70

[56] References Cited

U.S. PATENT DOCUMENTS

| | | | |
|---|---|---|---|
| 3,021,137 | 2/1962 | Palmer et al. | 482/71 |
| 3,572,701 | 3/1971 | Agamian | 482/132 |
| 3,791,645 | 2/1974 | Stelma | 482/71 |
| 4,132,404 | 1/1979 | Wilson | 482/132 |
| 5,147,266 | 9/1992 | Ricard | 482/131 |

*Primary Examiner*—Lynne A. Reichard
*Attorney, Agent, or Firm*—Kane, Dalsimer, Sullivan, Kurucz, Levy, Eisele and Richard

[57] ABSTRACT

The leg stretching device includes a slidable foot supporting plate mounted on a pair of rails extending between a pair of blocks. A person straddles one end of the device, places a foot on the plate, and obtains the desired stretch by urging the plate toward the other end.

8 Claims, 1 Drawing Sheet

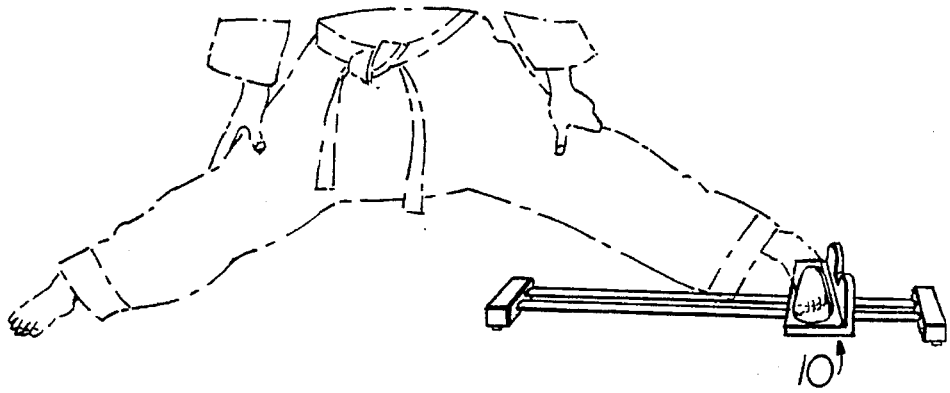
FIG.1
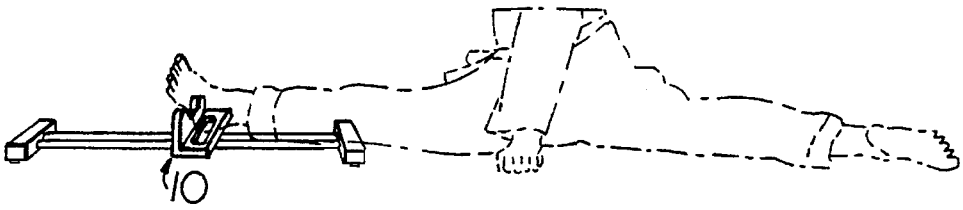
FIG.2
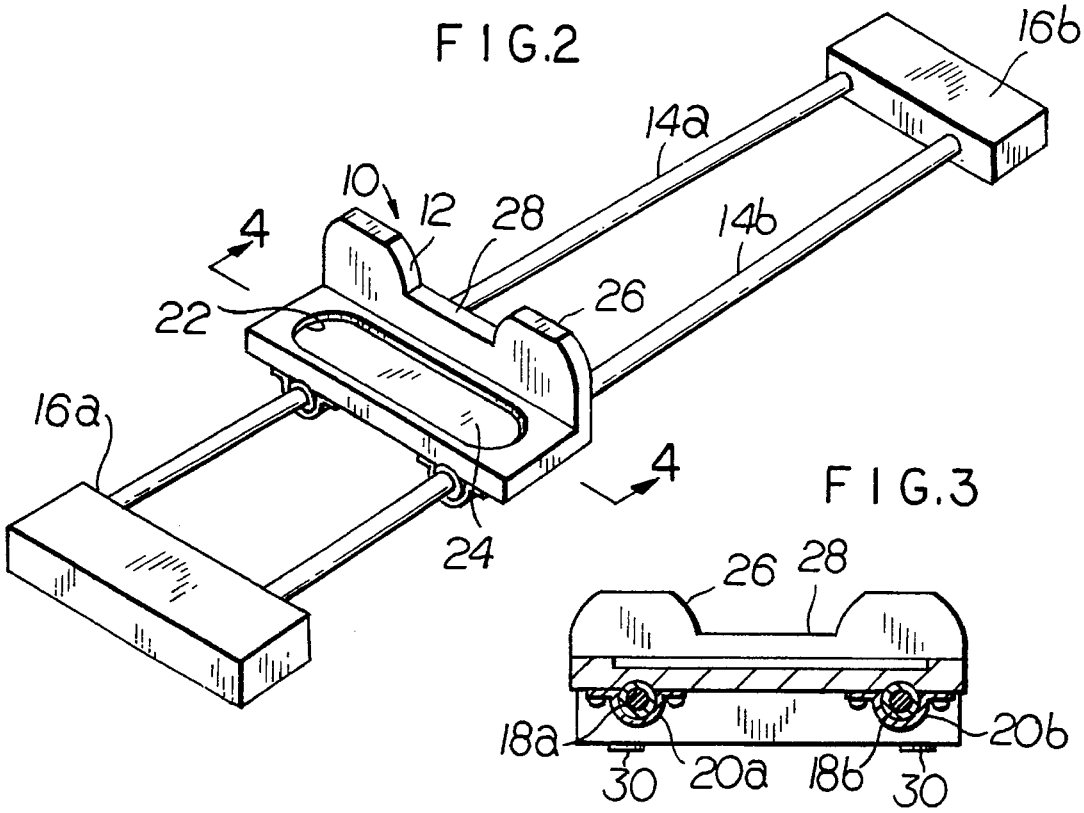
FIG.3
FIG.4

LEG STRETCHING DEVICE

BACKGROUND OF THE INVENTION

Stretching is normally an integral part of any exercise program. Stretching enhances strength and agility and improves performance during training and at competitions. It allows for greater fluidity of motion, decreases potential injury during competition, gymnastics, dance and eases muscle soreness. One such series of excersises is called leg stretching which requires an individual to move his feet apart while stiff to maximum separation of the feet.

Many stretching devices are currently on the market and mostly are either of the sitting type or standing type and for the most part are either too large or bulky to store easily or carry comfortably. Normally these devices have two foot rests or plates for stretching both legs. Some can also cause serious injury because they can flex or force muscles beyond their capable range of motion.

SUMMARY OF THE INVENTION

A principal object of the present invention is to provide a safe, and inexpensive stretching device that enables an individual, without the aid of a partner, to undergo a safe stretching routine.

Another object is to provide a stretching device of the foregoing type that can be easily stored or readily carried to competitions or a training studio.

A further object is to provide a stretching device of the foregoing type that dramatically increases one's stretching ability by providing an effective stretching aid for achieving competitive goals.

Still another object is to provide a stretching device of the foregoing type that builds strength in the legs through isometric stretching and at the same time improves flexibility that also contributes to improved quality and height of kicks whether for the martial arts, kick boxing, karate, gymnastics, dance aerobics or the like.

A still further object is to provide a stretching device of the foregoing type that stretches and strengthens muscles, ligaments, and tendons in the legs and lower back.

Another important object is to provide a stretching device of the foregoing type that permits the user to control the degree of stretch with gravity providing the force of the stretch and resistance opposing the stretch is maintained at a minimum. Several different stretching exercises are also achieved.

A further important object is to provide a leg stretching device of the foregoing type which possesses no height restrictions, typical in two foot rest or plate devices that stretch both legs simultaneously.

Still another object is to provide a stretching device of the foregoing type that utilizes no screws or other mechanical adjustments, typical with devices having two foot rests.

Other objects and advantages will become apparent from the following detailed description which is to be taken in conjunction with the accompanying drawings.

BRIEF DESCRIPTION OF THE DRAWINGS

In the drawings:

FIG. 1 is a perspective view of the stretching device of the present invention being used as a standing machine with a side split being performed for stretching both legs;

FIG. 2 is a perspective view of the stretching device being used as a standing machine with a front split being performed for stretching both legs;

FIG. 3 is an enlarged perspective view of the stretching machine;

FIG. 4 is a cross sectional view taken along the line 4—4 of FIG. 3.

DETAILED DESCRIPTION OF THE PREFERRED EMBODIMENTS

In the drawings, the stretching device 10 of the present invention includes a slidable single foot support plate 12 mounted on a pair of rails 14*a* and 14*b* extending between and firmly anchored, by any suitable securing means such as strategically located, rivets, screws or bolts, in a pair of blocks 16*a* and 16*b*. In this regard, bearings 18*a* and 18*b* embracing the respective rails 14*a* and 14*b* may be secured to the underside of the foot supporting plate 12 by brackets 20*a* and 20*b*, respectively. It should be understood that this invention contemplates molding the plate, bracket and appropriate bearings in one piece from suitable resin.

The top of the plate may be recessed at 22 and possess a roughened surface area 24 to increase the frictional engagement with the user's foot. A flange 26 extends upwardly from the plate top and in lieu of being in one piece as shown it may be interrupted. In any event, the flange provides further surfaces that the user's foot may engage to minimize if not avoid foot slippage. The interruption or cut out 28 permits the front end or toe portion of the user's foot to extend through the flange 26 when stretching as in FIG. 2.

The bottom of each block 16*a* and 16*b* may contain pads 30 to engage with the floor or any supporting surface to prevent slippage of the blocks when the stretching device 10 is in use.

In use, a user straddles one end of the stretching device 10, places a foot on the plate 12, and stretches both legs by urging the plate towards the other end of the device. The extent to which the user spreads his or her legs when straddling one end of the device 10 and the placement of the other foot relative to the proximal end with the other foot on the plate 12, will determine the extent to which the leg can be stretched. As shown in FIG. 1 the device 10 is displayed as a standing machine, wherein the user performs a split by urging the one movable leg outwardly towards the distal end of the device 10. Thus when used for a side split it does not matter which foot is placed on the plate 12.

Another important feature of the stretching device of the present invention is its ability to obtain the benefits of a sitting type machine with which the body is placed in a sitting position for stretching. In this regard, the user assumes the position of FIG. 1, bends at the waist and supports upper body weight by the hands. When this occurs, the user stretches those muscles that are normally stretched in a sitting type machine.

As shown in FIG. 2, the device 10 is deployed again as a standing machine, wherein a front split is performed by pushing the movable leg outwardly towards the distal end thereby stretching both legs but using different muscles. The same routine is performed with the other leg for a front split.

Thus, a front split, side split and sitting position for stretching are possible with the present invention. Moreover, the device 10 provides the same benefit as a two foot receiving stretch machine.

Thus, the aforenoted objects and advantages are most effectively attained. Although a single somewhat preferred embodiment has been described and disclosed in detail herein, it should be understood that this invention is in no sense restricted thereby and its scope is to be determined by that of the appended claims.

I claim:

1. A leg stretching device that may be readily carried and stored and obtains the benefits of a standing leg stretching type machine when performing a side split and front split and a sitting leg stretching type machine when performing a side split and thereafter the user bends at the waist, places his hand on the ground and thereby supports upper body weight comprising:

a slidable single foot receiving plate having a top, rail means having a proximal end and a distal end, journal means for slidably mounting the plate so that the rail means is disposed below the plate and the plate is on top of the rail means, said plate being fixed on the journal means, the rail means including a pair of horizontally spaced rails having opposed ends and support blocks anchoring the ends of the rails and spacing them a predetermined distance from one another horizontally and above a supporting surface, the plate having a bottom and the journal means being on the bottom for journaling the plate on the rail means, whereby a user straddles the proximal end of the device with his or her legs, spreading his or her feet to the desired extent and places a foot on the top of plate and moves the plate with this foot to the distal end until the desired stretch of both legs is attained, whereby the user is permitted to control the degree of stretch with gravity providing the force of the stretch and resistance opposing the stretch is maintained at a minimum.

2. The invention in accordance with claim 1 wherein the journal means including bearings for journaling the plate on the rail means.

3. The invention in accordance with claim 1 wherein the plate has a top and a recess is in the top for receiving a foot of the user.

4. The invention in accordance with claim 1 wherein the plate has a top and the top is roughened to increase friction with the feet of the user.

5. The invention in accordance with claim 1 wherein a flange extends upwardly from the top of the plate for engaging with the foot of the user to minimize slippage.

6. The invention in accordance with claim 5, wherein the flange is interrupted to permit the toe part of the feet of the user to extend therethrough.

7. The invention in accordance with claim 1 wherein the plate is molded of one piece.

8. The invention in accordance with claim 1 wherein the plate has a top and a recess is in the top for receiving a foot of the user;

the plate has a top and the top is roughened to increase friction with the feet of the user;

a flange extends upwardly from the top of the plate for engaging with the foot of the user to minimize slippage;

the flange is interrupted to permit the toe part of the feet of the user to extend therethrough;

the plate is molded of one piece.

* * * * *